US009621980B2

(12) United States Patent
Akino

(10) Patent No.: US 9,621,980 B2
(45) Date of Patent: Apr. 11, 2017

(54) DYNAMIC MICROPHONE UNIT AND DYNAMIC MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/872,702

(22) Filed: Oct. 1, 2015

(65) Prior Publication Data

US 2016/0112793 A1 Apr. 21, 2016

(30) Foreign Application Priority Data

Oct. 17, 2014 (JP) ..... 2014-212294

(51) Int. Cl.

| | |
|---|---|
| ***H04R 1/02*** | (2006.01) |
| ***H04R 1/28*** | (2006.01) |
| *H04R 25/00* | (2006.01) |
| *H04R 9/02* | (2006.01) |
| *H04R 9/08* | (2006.01) |
| *H04R 1/22* | (2006.01) |
| *H04R 1/08* | (2006.01) |
| *H04R 9/04* | (2006.01) |

(52) U.S. Cl.

CPC ..... *H04R 1/2876* (2013.01); *H04R 1/083* (2013.01); *H04R 1/222* (2013.01); *H04R 9/025* (2013.01); *H04R 9/046* (2013.01); *H04R 9/08* (2013.01); *H04R 2410/03* (2013.01)

(58) Field of Classification Search

CPC ..... H04R 1/2876; H04R 1/222; H04R 9/025; H04R 9/08

USPC ..... 381/354, 150, 162, 179, 345–348, 353, 381/355, 369

See application file for complete search history.

(56) References Cited

U.S. PATENT DOCUMENTS 8,644,544 B2 * 2/2014 Akino ..... H04R 1/283 381/150

FOREIGN PATENT DOCUMENTS

| | | |
|---|---|---|
| JP | 2013-55396 A | 3/2013 |
| JP | 2013-055397 A | 3/2013 |
| JP | 2013-141189 A | 7/2013 |

* cited by examiner

*Primary Examiner* — Sunita Joshi
(74) *Attorney, Agent, or Firm* — Manabu Kanesaka

(57) ABSTRACT

A dynamic microphone includes: a diaphragm; a voice coil fixed to the diaphragm; a magnetic circuit which includes a magnetic gap in which the voice coil is arranged and generates a magnetic field in the magnetic gap; a volume reducing member which is attached to the magnetic circuit, is arranged in a back surface space of the diaphragm, and reduces a volume in an air chamber in the back surface space; a communication passage which is formed along between the volume reducing member and the magnetic circuit and communicates the back surface space with a back side air chamber; and an acoustic resistance which is attached to the magnetic circuit and intervenes between the communication passage and the back side air chamber.

17 Claims, 5 Drawing Sheets

DYNAMIC MICROPHONE UNIT AND DYNAMIC MICROPHONE

RELATED APPLICATIONS

The present application is based on, and claims priority from, Japanese Application No. JP2014-212294 filed Oct. 17, 2014, the disclosure of which is hereby incorporated by reference herein in its entirety.

BACKGROUND OF THE INVENTION

Field of the Invention

The present invention relates to a dynamic microphone unit, and especially relates to a dynamic microphone unit which prevents that unevenness in frequency response is caused by resonance between an air chamber formed on a back surface of a diaphragm and an acoustic mass formed to a magnetic gap portion, and a dynamic microphone using the dynamic microphone unit.

Description of the Related Art

A non-directivity component of a dynamic microphone is resistance control. Therefore, an acoustic resistance is arranged on a back surface side of a diaphragm, and a back surface of the diaphragm is connected to a back side air chamber via the acoustic resistance. Accordingly, resistance control is realized by the acoustic resistance.

FIG. 6 is a sectional view illustrating an example of a conventional dynamic microphone unit. A reference sign 1 denotes a magnetic circuit. A disc-shaped magnet 2 is provided at a center of the magnetic circuit 1, and a disc-shaped pole piece 3 is arranged so as to come into contact with one side of magnetic poles of the magnet 2.

Further, a tail york 4 is provided so as to come into contact with another side of magnetic poles of the magnet 2. A peripheral edge of the tail york 4 is annularly erected, and a disc-shaped magnetic gap G is formed between an inner peripheral surface of the erected portion and a peripheral edge surface of the pole piece 3.

Through-holes 5 are concentrically formed so as to penetrate a center of the pole piece 3, the magnet 2, and the tail york 4.

The magnetic circuit 1 including the magnet 2, the pole piece 3, and the tail york 4 is attached to a unit case 6 supporting the tail york 4. A diaphragm 7 is attached to a front surface of an opening edge of the unit case 6.

The diaphragm 7 includes a center dome 7*a* and a sub dome 7*b*. A front surface of the center dome 7*a* is projected in a hemisphere shape. The sub dome 7*b* is formed annularly along a peripheral edge of the center dome 7*a*, and a front surface of the sub dome 7*b* is formed so as to project in an arc shape. A voice coil 8 is fixed to the diaphragm 7, for example, by using an adhesive at a boundary portion between the center dome 7*a* and the sub dome 7*b* on a back surface side of the diaphragm 7.

A peripheral edge of the sub dome 7*b* is attached to an opening edge of the unit case 6. The voice coil 8 is positioned in the magnetic gap G in such a state. When a sound wave is received in the configuration, the center dome 7*a* and the voice coil 8 can integrally vibrate in a front-back direction around an outer peripheral edge of the sub dome 7*b* by a sound pressure of the sound wave.

Accordingly, the voice coil 8 crosses a magnetic field generated in the magnetic gap G and outputs an audio signal based on vibration of the diaphragm 7.

Also, an equalizer 9 also functioning as a protective member for the diaphragm 7 is attached on an outer peripheral surface of a front edge of the unit case 6 so as to cover the unit case 6 and the diaphragm 7. A surface opposing to the center dome 7*a* at a center of the equalizer 9 is formed in a spherical shape which is recessed so that a fixed gap between the center dome 7*a* is kept.

Further, an opening 9*a* is formed at a center of the equalizer 9, and multiple openings 9*b* are formed along a periphery of the equalizer 9, to introduce a sound wave from the outside into the diaphragm 7.

A back surface side of the unit case 6 opens in a cylindrical shape, and a container-like lid 11 is attached by fitting to the cylindrical opening and closes a back surface of the unit case 6. In this manner, a back side air chamber 12 with a relatively large volume is formed in the container-like lid 11. The back side air chamber 12 is formed on a back side (side opposite to the diaphragm 7) of the magnetic circuit 1.

On the other hand, a volume reducing member 13 formed in a lens shape is arranged so as to oppose to a back surface of the center dome 7*a*. The volume reducing member 13 is attached, for example, by an adhesive to the pole piece 3 included in the magnetic circuit 1. A front surface of the volume reducing member 13 is projected in a spherical shape along a back surface of the center dome 7*a*.

At a center of the volume reducing member 13, a through-hole (denoted by a reference sign 5 as with the through-holes of the magnetic circuit) is formed concentrically with the through-holes 5 formed to the magnet 2, the pole piece 3, and the tail york 4, which are included in the magnetic circuit 1.

Thus, a back surface of the diaphragm 7 is communicated with the back side air chamber 12 formed in the container-like lid 11 via the through-hole 5.

An acoustic resistance body 14 is attached to the through-hole 5 of the volume reducing member 13.

The acoustic resistance body 14 illustrated in the example is formed in a sheet-like shape. Therefore, a planer recessed portion 13*a* is formed at a center of the volume reducing member 13, and the sheet-like acoustic resistance body 14 is attached by an adhesive by using the recessed portion 13*a*.

The volume reducing member 13 is used to prevent that an air chamber with a small volume is formed between a back surface of the diaphragm 7, especially a back surface of the center dome 7*a*, and the pole piece 3 of the magnetic circuit 1.

Specifically, in the case where an air chamber with a small volume is formed between a back surface of the diaphragm 7 and the pole piece 3 included in the magnetic circuit 1, the air chamber works as an acoustic volume (C component).

On the other hand, as described above, the voice coil 8 is arranged in the magnetic gap G, and therefore, each of an acoustic resistance (R component) and an acoustic mass (L component) is formed on an inner side and an outer side of the voice coil 8.

Therefore, resonance occurs between an acoustic volume (C component) of the air chamber and an acoustic mass (L component) formed to the magnetic gap G, and unevenness in frequency response of a microphone unit is caused.

A resonance frequency at this time is preferably equal to or greater than an upper limit of a main sound collective band of a microphone unit. Therefore, the lens-shaped volume reducing member 13 is arranged on a front surface of the pole piece 3 to reduce the acoustic volume (C component), and the resonance frequency is preferably set out of the sound collective band.

JP 2013-55396 A, JP 2013-55397 A, and JP 2013-141189 A disclose a dynamic microphone unit, in which the lens-shaped volume reducing member 13 is arranged on a front surface of the magnetic circuit 1, and a back surface of the diaphragm 7 is communicated with the back side air chamber 12 via the through-hole 5 formed at a center of the volume reducing member 13, as described above.

In the dynamic microphone unit illustrated in FIG. 6, the lens-shaped volume reducing member 13 is arranged on a front surface of the pole piece 3, and a recessed portion 13*a* for adhering an acoustic resistance body 14 is formed at a center of the volume reducing member 13 although the configuration, in which an acoustic volume (C component) in an air chamber formed on a back surface of the center dome 7*a* is reduced, is applied.

Therefore, the recessed portion 13*a* still acts as an acoustic volume, and this acoustic volume acts with an acoustic mass (L component) formed to the magnetic gap G. Accordingly, resonance in a sound collective band of a microphone unit is still caused.

SUMMARY OF THE INVENTION

The present invention is based on the above-described technical viewpoint, and an object of the present invention is to provide a dynamic microphone unit prevents disorder in frequency response by the resonance by improving a communication passage to a back side air chamber formed to the lens-shaped volume reducing member and an acoustic resistance body and especially reducing an acoustic volume in an air chamber formed on an back surface of a center dome, and provide a dynamic microphone using the dynamic microphone unit.

In a first embodiment preferred to a dynamic microphone unit according to the present invention to achieve the above issue, the dynamic microphone unit includes: a diaphragm; a voice coil fixed to the diaphragm; a magnetic circuit which includes a magnetic gap in which the voice coil is arranged and generates a magnetic field in the magnetic gap; a volume reducing member which is attached to the magnetic circuit, is arranged in a back surface space of the diaphragm, and reduces a volume in an air chamber in the back surface space; a communication passage which is formed along between the volume reducing member and the magnetic circuit and communicates the back surface space with a back side air chamber formed on a back side of the magnetic circuit; and an acoustic resistance which is attached to the magnetic circuit and intervenes between the communication passage and the back side air chamber.

Further, in a second embodiment preferred to the dynamic microphone unit according to the present invention to achieve the above issue, the dynamic microphone unit includes: a diaphragm; a voice coil fixed to the diaphragm; a magnetic circuit which includes a magnetic gap in which the voice coil is arranged and generates a magnetic field in the magnetic gap; a volume reducing member which is attached to the magnetic circuit, is arranged in a back surface space of the diaphragm, and reduces a volume in an air chamber in the back surface space; and an acoustic resistance comprising a thin air layer, which is formed along between the volume reducing member and the magnetic circuit and communicates the back surface space with a back side air chamber formed on a back side of the magnetic circuit.

In this case, in the first embodiment, a through-hole formed to the magnetic circuit is intervened between the communication passage and the back side air chamber, and the acoustic resistance formed in a column shape is arranged in the through-hole.

Further, in this case, the volume reducing member is preferably supported on the magnetic circuit by the acoustic resistance formed in a column shape.

Further, in the first embodiment, the through-hole formed to the magnetic circuit is intervened between the communication passage and the back side air chamber, and the acoustic resistance formed in a sheet-like shape is arranged between the through-hole and the back side air chamber to close the through-hole.

Further, in the first and second embodiments, the diaphragm includes a center dome and an annular sub dome. A front surface of the center dome is projected in a hemisphere shape. The annular sub dome is formed along a peripheral edge of the center dome. A surface opposing to the center dome in the volume reducing member is formed in a spherical shape along a back surface of the center dome.

In addition, the sub dome is annularly formed along a peripheral edge of the center dome, and a front surface thereof is formed so as to project in an arc shape. A second volume reducing member which is annularly formed along a back surface of the sub dome and in which a front surface thereof is projected in an arc shape is preferably further arranged in a back surface space of the sub dome.

The dynamic microphone unit having the above-described configuration can be provided as a dynamic microphone assembled in a microphone case.

According to the dynamic microphone unit having the configuration and the dynamic microphone using the dynamic microphone unit, a volume reducing member to reduce a volume in a back surface space of a diaphragm is attached to a magnetic circuit, the back surface space of the diaphragm communicates with a back side air chamber via a communication passage formed along between the volume reducing member and the magnetic circuit.

In the first embodiment, an acoustic resistance is attached to a magnetic circuit just behind the communication passage, and a back surface space is communicated via the acoustic resistance.

In the second embodiment, the communication passage formed along between the volume reducing member and the magnetic circuit is an acoustic resistance including a thin air layer.

Therefore, according to the first and second embodiments, a volume in aback surface space of a diaphragm can be certainly reduced in comparison with a conventional configuration illustrated in FIG. 6, in which a recessed portion is formed at a center of a lens-shaped volume reducing member to arrange an acoustic resistance.

In this manner, it is possible to provide a dynamic microphone unit which can reduce an acoustic volume in an air chamber formed on aback surface of a diaphragm and effectively prevent disorder in frequency response by the resonance, and provide a dynamic microphone using the dynamic microphone unit.

DESCRIPTION OF THE PREFERRED EMBODIMENTS

A dynamic microphone unit according to the present invention will be described with reference to FIGS. 1 to 5. In each embodiment to be described below, portions having the same functions as the portions illustrated in FIG. 6 and already described above are denoted by the same reference signs. Therefore, detailed descriptions thereof will be appropriately omitted.

Figure 1:
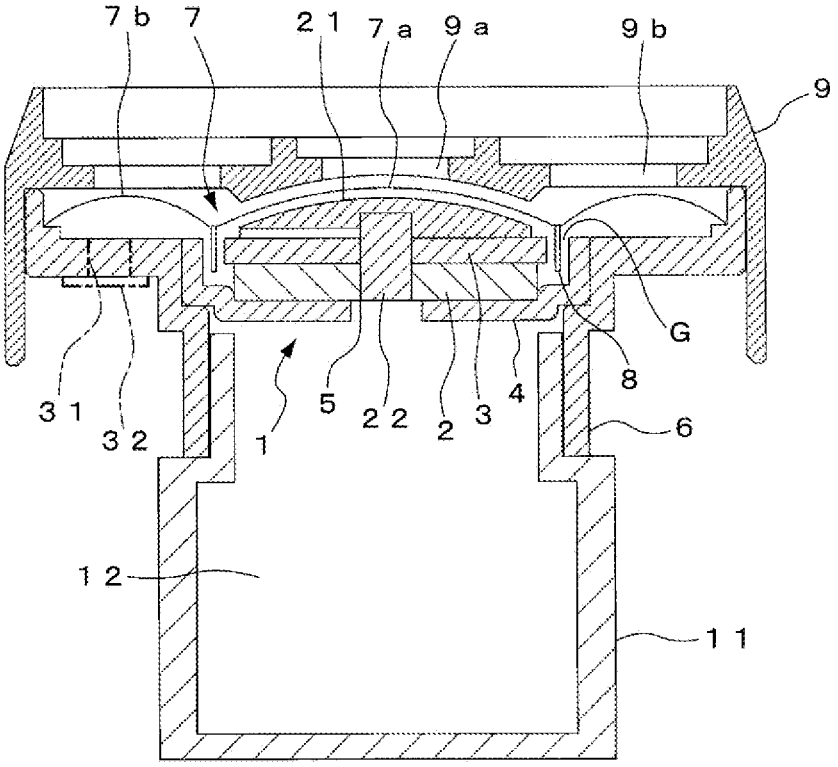
FIG. 1 is a sectional view illustrating a first example of a dynamic microphone unit according to the present invention.
Figure 2A:
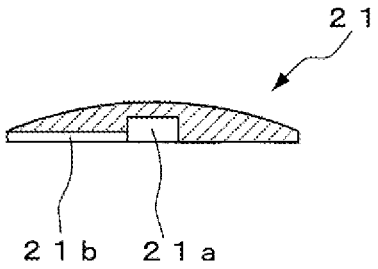
FIG. 2A is a sectional view illustrating a volume reducing member formed in a lens shape.
Figure 2B:
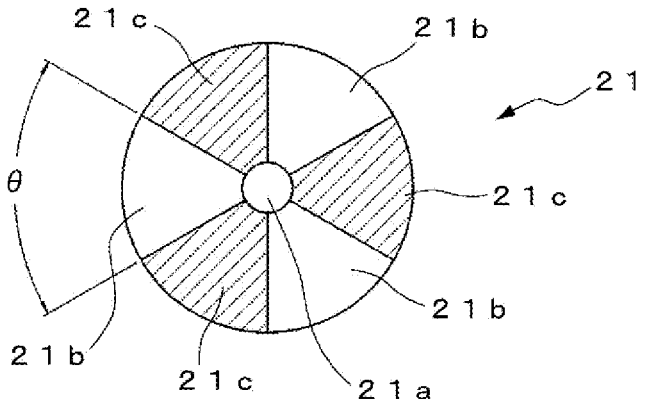
FIG. 2B is a bottom view of the volume reducing member.

A volume reducing member 21 illustrated in FIGS. 2A and 2B is used in a first configuration of the dynamic microphone unit according to the present invention, which is illustrated in FIG. 1.

As described above, the volume reducing member 21 is attached on a front surface of a pole piece 3 included in a magnetic circuit 1, is arranged in a back surface space of a diaphragm 7, and reduces a volume in an air chamber of the back surface space.

Specifically, as illustrated in FIG. 1, a front surface of the volume reducing member 21 opposes to a back surface of a center dome 7*a* and is formed in a spherical shape along a back surface of the center dome 7*a*. Accordingly, a fixed gap of about 0.5 mm is formed between a front surface of the volume reducing member 21 and a back surface of the center dome 7*a*.

As illustrated in FIGS. 2A and 2B, a bottomed hole 21*a* is formed at a center of a back surface of the volume reducing member 21, and multiple cut-out portions 21*b* are formed in a fan shape around the bottomed hole 21*a*.

Specifically, as illustrated in FIG. 2B, in the fan-shaped cut-out portions 21*b* arranged on a back surface of the volume reducing member 21, a fan angle θ around the bottomed hole 21*a* is set to about 60 degree, and three cut-out portions 21*b* are formed at equal intervals in a circumferential direction. Therefore, remained surfaces 21*c* other than the fan-shaped cut-out portions 21*b* illustrated in FIG. 2B function as a bonding surface to the pole piece 3 included in the magnetic circuit 1.

An acoustic resistance 22 formed in a column shape is inserted into a through-hole 5 formed to the magnetic circuit 1 as illustrated in FIG. 1. A tip of the column-shaped acoustic resistance 22 is inserted into the bottomed hole 21*a* of the volume reducing member 21, and the volume reducing member 21 is positioned with respect to the magnetic circuit 1 and attached on a front surface of the pole piece 3.

In this case, on a bonding surface 21*c* to a pole piece of the volume reducing member 21, the volume reducing member 21 is preferably bonded to the pole piece 3 in a state in which an adhesive is applied in advance Then, the fan-shaped cut-out portion 21*b* arranged to the volume reducing member 21 functions as a communication passage formed along between the volume reducing member 21 and the magnetic circuit 1 as illustrated in FIG. 1. Specifically, a back surface space of the diaphragm 7 communicates with the above-described back side air chamber 12 via the communication passage (cut-out portion 21*b*) and the acoustic resistance 22. The acoustic resistance 22 formed in a column shape is attached to the magnetic circuit 1 and functions as an acoustic resistance which intervenes between the communication passage (cut-out portion 21*b*) and the back side air chamber 12.

A gap by the communication passage (cut-out portion 21*b*) in this case is preferably set to about 0.4 mm. Further, the fan angle θ of the cut-out portion 21*b* for forming a communication passage can be appropriately set within a range of 3 to 60 degree, for example, as necessary.

A sintered plastic material can be preferably used for the column-shaped acoustic resistance 22. For example, resin powder can be provided in a porous state by pressurizing and heating the resin powder in a cylindrical pattern. Various acoustic resistance values can be selected in accordance with a particle diameter of the resin powder and a pressurization level.

In addition, a sintered plastic member can have a certain level of mechanical intensity, and therefore the sintered plastic member can be used for positioning the volume reducing member 21 with respect to the magnetic circuit 1 as described above.

According to the dynamic microphone unit illustrated in FIG. 1, a communication passage for communicating a back surface space of the diaphragm 7 with the back side air chamber 12 is formed along between the volume reducing member 21 and the magnetic circuit 1. Therefore, an acoustic volume in an air chamber formed on aback surface of the diaphragm 7 can be further reduced in comparison with a conventional dynamic microphone unit illustrated in FIG. 6.

Therefore, it is possible to provide a dynamic microphone unit which effectively prevents disorder in frequency response by resonance between an air chamber formed on a back surface of the diaphragm 7 and an acoustic mass formed at a magnetic gap G.

An example illustrated in FIG. 1 indicates a non-directive dynamic microphone in which the back side air chamber 12 is sealed by a container-like lid 11. The back side air chamber 12 is formed on a back side (side opposite to the diaphragm 7) of the magnetic circuit 1.

In this case, for example, as illustrated by a virtual line in FIG. 1, multiple back side acoustic terminal holes 31 are formed in a circumferential direction at an opening edge of a unit case 6, and a bi-directional component can be added on a back surface of the diaphragm 7 by attaching a sheet-like acoustic resistance 32 to each of the back side acoustic terminal holes 31.

Accordingly, a unidirectional dynamic microphone unit can be provided which has almost the same effect as in the example illustrated in FIG. 1.

Figure 3:
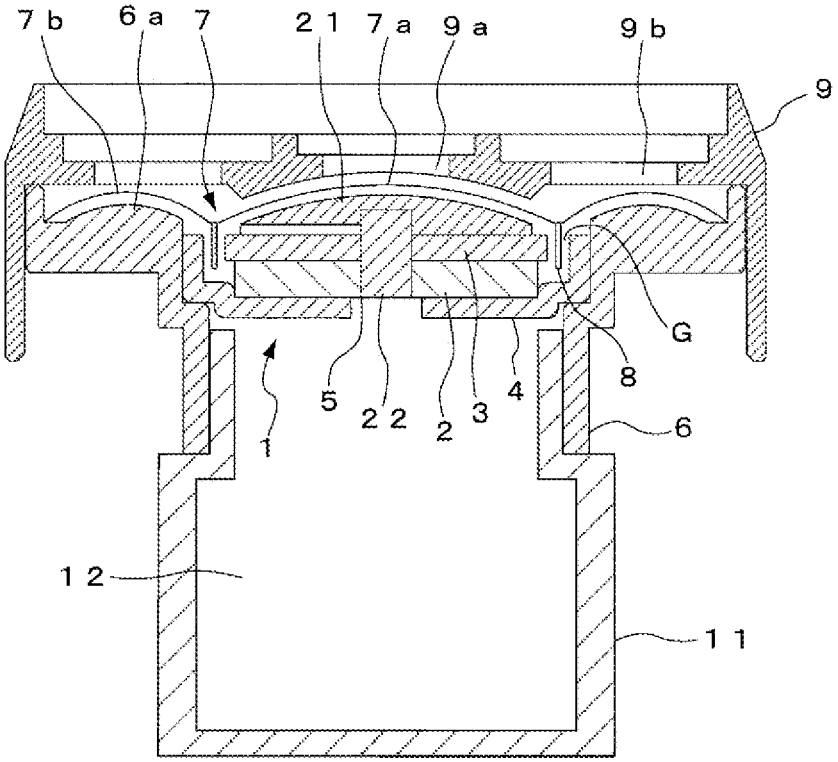
FIG. 3 is a sectional view illustrating a second example of the dynamic microphone unit according to the present invention.

FIG. 3 illustrates a second configuration of the dynamic microphone unit according to the present invention. In the example illustrated in FIG. 3, a volume reducing member is provided in a back surface space of a sub dome 7*b* in addition to a configuration of the dynamic microphone unit illustrated in FIG. 1.

Specifically, the sub dome 7*b* is annularly formed along a peripheral edge of the center dome 7*a*, and a front surface thereof is formed so as to project in an arc shape.

Therefore, in a back surface space of the sub dome 7*b*, a second volume reducing member 6*a* is arranged. The second volume reducing member 6*a* is annularly formed along a back surface of the sub dome and a front surface thereof is projected in an arc shape. The second volume reducing member 6*a* is integrally formed along an opening edge of the unit case 6 on a front surface side of the unit case 6.

Accordingly, a fixed gap of about 0.5 mm is formed between a front surface of the second volume reducing member 6*a* and a back surface of the sub dome 7*b*, and an acoustic volume in an air chamber formed on a back surface of the sub dome 7*b* can be set smaller.

Therefore, according to the configuration illustrated in FIG. 3, a dynamic microphone unit can be provided in which an effect to prevent disorder in frequency response by resonance between an air chamber formed on a back surface of the sub dome 7*b* and an acoustic mass formed to the magnetic gap G is added in addition to the above-described effect by the dynamic microphone unit illustrated in FIG. 1.

Figure 4:
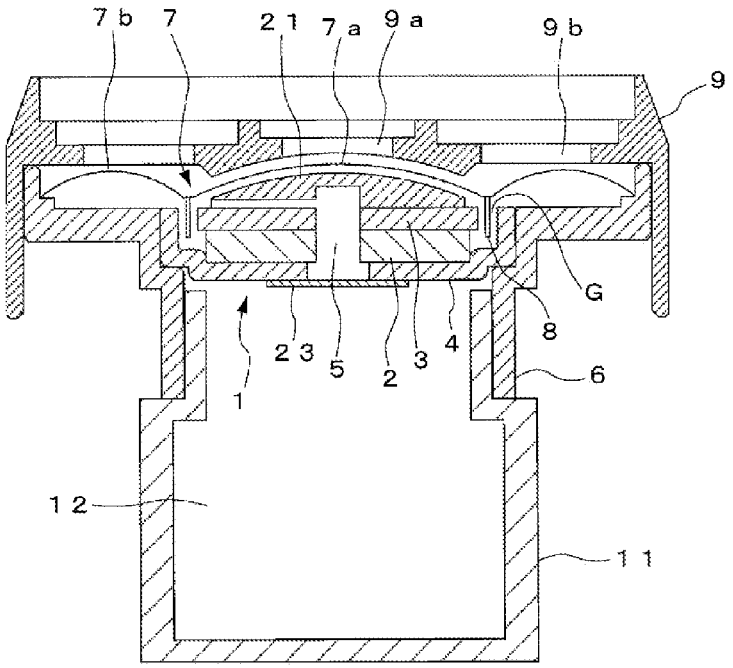
FIG. 4 is a sectional view illustrating a third example of the same.

FIG. 4 illustrates a third configuration of the dynamic microphone unit according to the present invention. A sheet-like acoustic resistance 23 is used in the third example, although the column-shaped acoustic resistance 22 is used in the example illustrated in FIG. 1. Other configuration is the same as a configuration of the dynamic microphone unit illustrated in FIG. 1.

Specifically, as illustrated in FIG. 4, the sheet-like acoustic resistance 23 is attached, for example, by using an adhesive so as to close the through-hole 5 formed at a center of a tail york included in the magnetic circuit 1.

According to the configuration, the sheet-like acoustic resistance 23 is intervened between a communication passage (the cut-out portion 21*b* of the volume reducing member 21) formed along between the volume reducing member 21 and the magnetic circuit 1 and the through-hole 5, and the back side air chamber 12.

Therefore, in the configuration of the dynamic microphone unit illustrated in FIG. 4, an effect similar to that of the dynamic microphone unit illustrated in FIG. 1 can be provided.

Figure 5:
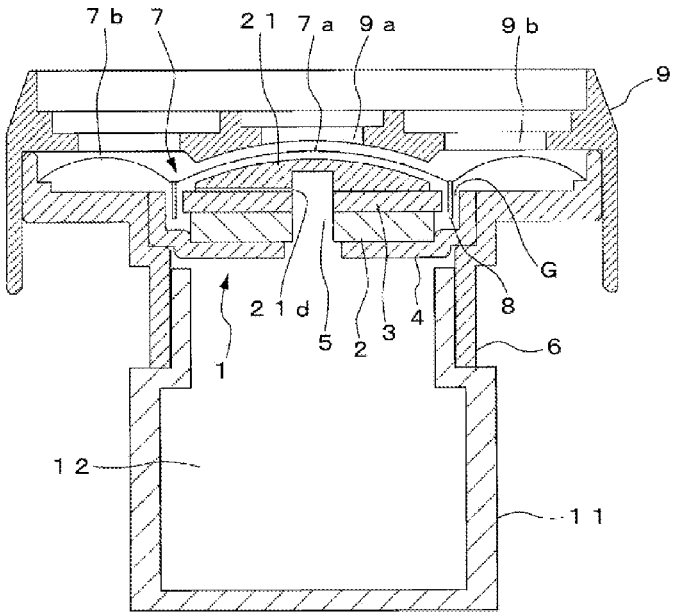
FIG. 5 is a sectional view illustrating a fourth example of the same.
Figure 6:
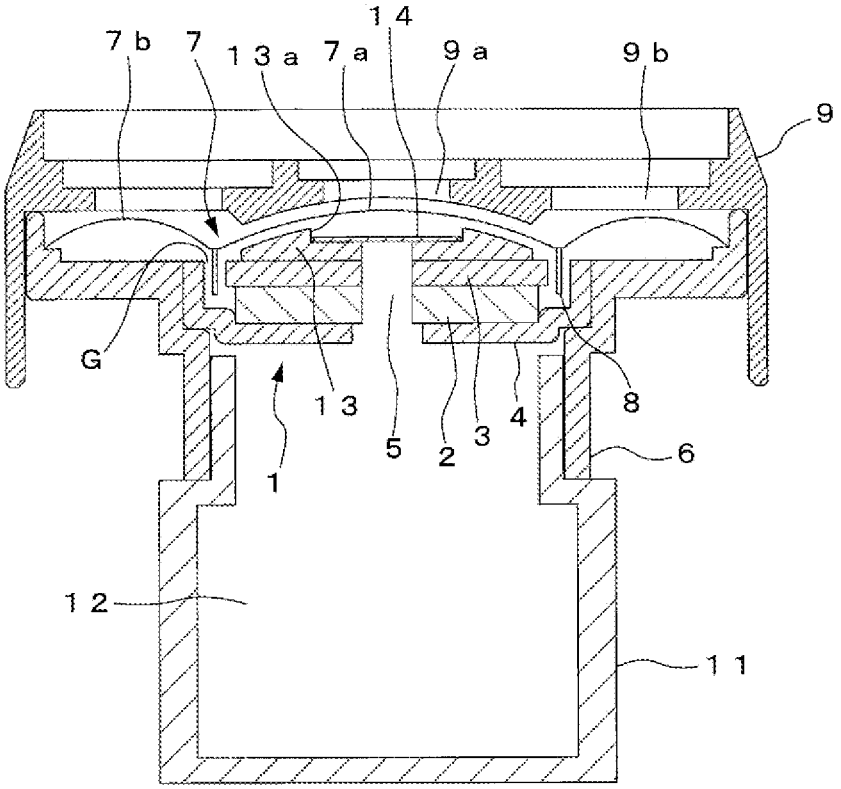
Fig. 6 Prior Art
FIG. 6 is a sectional view illustrating an example of a conventional dynamic microphone unit.

FIG. 5 illustrates a fourth configuration of the dynamic microphone unit according to the present invention. In the fourth example, an acoustic resistance including a thin air layer is used instead of the column-shaped acoustic resistance 22 and the sheet-like acoustic resistance 23.

Specifically, in a configuration of the volume reducing member 21 used in the example, a gap with the magnetic circuit 1 generated by the cut-out portion 21*b* illustrated in FIGS. 2A and 2B is set much smaller, and an acoustic resistance by a thin air layer is formed between the volume reducing member 21 and the magnetic circuit 1.

In FIG. 5, an acoustic resistance by a thin air layer is denoted by a reference sign 21*d*. To form the acoustic resistance 21*d* by the thin air layer, a gap between the volume reducing member 21 and the pole piece 3 included in the magnetic circuit 1 is set to about 50 μm.

According to a configuration of the dynamic microphone unit illustrated in FIG. 5, a back surface space of the diaphragm 7 is communicated with the back side air chamber 12 via the acoustic resistance 21*d* by a thin air layer formed along between the volume reducing member 21 and the magnetic circuit 1.

Accordingly, a dynamic microphone unit can be provided which has almost the same effect as in the above-described example illustrated in FIG. 1.

In the dynamic microphone unit illustrated in FIGS. 4 and 5, the second volume reducing member 6*a* can be formed on a back surface space of the sub dome 7*b* as with the example illustrated in FIG. 3.

Accordingly, the same effect as in the example described based on FIG. 3 can be provided.

The above-described dynamic microphone unit can form an applicable dynamic microphone by being assembled to a microphone case and incorporating a connector to output an output signal of a microphone unit to the outside into the microphone case.

What is claimed is:

1. A dynamic microphone unit, comprising:

a diaphragm;

a voice coil fixed to the diaphragm;

a magnetic circuit which includes a magnetic gap in which the voice coil is arranged and generates a magnetic field in the magnetic gap;

a volume reducing member which is attached to the magnetic circuit, is arranged in a back surface space of the diaphragm, and reduces a volume in an air chamber in the back surface space;

a communication passage which is formed along between the volume reducing member and the magnetic circuit and communicates the back surface space with a back side air chamber formed on a back side of the magnetic circuit; and an acoustic resistance which is attached to the magnetic circuit and intervenes between the communication passage and the back side air chamber, wherein a surface of the volume reducing member facing the magnetic circuit includes a bonding surface bonding to the magnetic circuit and a cut-out portion forming the communicating passage along between the volume reducing member and the magnetic circuit.

2. A dynamic microphone unit, comprising:

a diaphragm;

a voice coil fixed to the diaphragm;

a magnetic circuit which includes a magnetic gap in which the voice coil is arranged and generates a magnetic field in the magnetic gap;

a volume reducing member which is attached to the magnetic circuit, is arranged in a back surface space of the diaphragm, and reduces a volume in an air chamber in the back surface space; and an acoustic resistance comprising a thin air layer, which is formed along between the volume reducing member and the magnetic circuit and communicates the back surface space with a back side air chamber formed on a back side of the magnetic circuit, wherein a surface of the volume reducing member facing the magnetic circuit includes a bonding surface bonding to the magnetic circuit and a cut-out portion forming the acoustic resistance comprising the thin air layer along between the volume reducing member and the magnetic circuit.

3. The dynamic microphone unit according to claim 1, wherein a through-hole formed in the magnetic circuit is intervened between the communication passage and the back side air chamber, and the acoustic resistance formed in a column shape is arranged in the through-hole.

4. The dynamic microphone unit according to claim 3, wherein the volume reducing member is supported on the magnetic circuit by the acoustic resistance formed in the column shape.

5. The dynamic Microphone unit according to claim 1, wherein a through-hole formed in the magnetic circuit is intervened between the communication passage and the back side air chamber, and the acoustic resistance formed in a sheet-like shape is arranged between the through-hole and the back side air chamber to close the through-hole.

6. The dynamic microphone unit according to claim 1, wherein the diaphragm comprises a center dome, in which a front surface is projected in a hemisphere shape, and an annular sub dome formed along a peripheral edge of the center dome, and a surface opposing to the center dome in the volume reducing member is formed in a spherical shape along a back surface of the center dome.

7. The dynamic microphone unit according to claim 2, wherein the diaphragm comprises a center dome, in which a front surface is projected in a hemisphere shape, and an annular sub dome formed along a peripheral edge of the center dome, and a surface opposing to the center dome in the volume reducing member is formed in a spherical shape along a back surface of the center dome.

8. The dynamic microphone unit according to claim 6, wherein the sub dome is annularly formed along the peripheral edge of the center dome, and a front surface of the sub dome is formed so as to project in an arc shape, and a second volume reducing member which is annularly formed along a back surface of the sub dome and in which a front surface is projected in an arc shape is further arranged in a back surface space of the sub dome.

9. The dynamic microphone unit according to claim 7, wherein the sub dome is annularly formed along the peripheral edge of the center dome, and a front surface of the sub dome is formed so as to project in an arc shape, and a second volume reducing member which is annularly formed along a back surface of the sub dome and in which a front surface is projected in an arc shape is further arranged in a back surface space of the sub dome.

10. A dynamic microphone, wherein the dynamic microphone unit according to claim 1 is assembled in a microphone case.

11. A dynamic microphone, wherein the dynamic microphone unit according to claim 2 is assembled in a microphone case.

12. The dynamic microphone unit according to claim 1, wherein the cut-out portion extends from a center of the volume reducing member facing the magnetic circuit to an edge of the volume reducing member in a radial direction of the volume reducing member.

13. The dynamic microphone unit according to claim 12, wherein the bonding surface includes a plurality of bonding sections, the cut-out portion includes a plurality of cut-out sections, and each cut-out section is formed between two bonding sections adjacent to each other.

14. The dynamic microphone unit according to claim 13, wherein the volume reducing member further comprises a bottomed hole having an opening arranged at the center of the volume reducing member facing the magnetic circuit.

15. The dynamic microphone unit according to claim 2, wherein the cut-out portion extends from a center of the volume reducing member facing the magnetic circuit to an edge of the volume reducing member in a radial direction of the volume reducing member.

16. The dynamic microphone unit according to claim 15, wherein the bonding surface includes a plurality of bonding sections, the cut-out portion includes a plurality of cut-out sections, and each cut-out section is formed between two bonding sections adjacent to each other.

17. The dynamic microphone unit according to claim 16, wherein the volume reducing member further comprises a bottomed hole having an opening arranged at the center of the volume reducing member facing the magnetic circuit.

* * * * *